US006098037A

United States Patent [19]

Yeldener

[11] Patent Number: 6,098,037

[45] Date of Patent: Aug. 1, 2000

[54] FORMANT WEIGHTED VECTOR QUANTIZATION OF LPC EXCITATION HARMONIC SPECTRAL AMPLITUDES

[75] Inventor: Suat Yeldener, Dallas, Tex.

[73] Assignee: Texas Instruments Incorporated, Dallas, Tex.

[21] Appl. No.: 09/081,434

[22] Filed: May 19, 1998

Related U.S. Application Data

[60] Provisional application No. 60/047,170, May 20, 1997.

[51] Int. Cl.[7] ..... G10L 19/02

[52] U.S. Cl. ..... 704/221; 704/219; 704/222; 704/230

[58] Field of Search ..... 704/205–207, 704/219–223, 229, 230, 500, 501

[56] References Cited

U.S. PATENT DOCUMENTS

| | | | |
|---|---|---|---|
| 4,975,956 | 12/1990 | Liu et al. | 704/219 |
| 5,012,518 | 4/1991 | Liu et al. | 704/222 |
| 5,384,891 | 1/1995 | Asakawa et al. | 704/220 |
| 5,630,011 | 5/1997 | Lim et al. | 704/205 |
| 5,680,507 | 10/1997 | Chen | 704/223 |
| 5,754,974 | 5/1998 | Griffin et al. | 704/206 |
| 5,809,459 | 9/1998 | Bergstrom et al. | 704/223 |

OTHER PUBLICATIONS

J.C. Hardwick "A 4.8 kb/s Multi–Band Excitation Speech Coder", S.M. Thesis, E.E.C.S. Department, M.I.T., 1988, pp. 36–57.

A. Das, A. Rao, A. Gersho "Variable Dimension Vector Quantization of Speech Spectra for Low Rate Vocoders", Proc. IEEE Data Compression Conf., Apr. 1994, pp: 420–429.

V. Cuperman, P. Lupini, B. Bhattacharya "Spectra Excitation Coding of Speech at 2.4 kb/s", Proc. ICASSP, 1995, pp: 496–499.

*Primary Examiner*—David D. Knepper

*Attorney, Agent, or Firm*—Robert L. Troike; Frederick J. Telecky, Jr.

[57] ABSTRACT

A method of quantizing harmonic amplitudes (FIG. 3), used in a speech encoder (10). The method compares variable dimension input vectors to fixed dimension codebook vectors, by first sampling each codebook vector so that it is converted to a vector having the same dimension as the input vector (FIG. 3, step 35). The resulting codebook vector is compared to the input vector (step 37). The difference (error) is weighted in favor of low frequency harmonics. Also, the weighting favors formant amplitudes so that they are quantized more accurately than formant nulls (FIG. 3, step 38; FIG. 5).

14 Claims, 5 Drawing Sheets

FORMANT WEIGHTED VECTOR QUANTIZATION OF LPC EXCITATION HARMONIC SPECTRAL AMPLITUDES

This application claims priority under 35 USC § 119 (e)(1) of provisional application number 60/047,170, filed May 20, 1997.

TECHNICAL FIELD OF THE INVENTION

The present invention relates generally to the field of speech coding, and more particularly to encoding methods for quantizing harmonic spectral amplitudes that are part of an LPC (linear prediction coding) excitation signal.

BACKGROUND OF THE INVENTION

Various methods have been developed for digital encoding of speech signals. The encoding enables the speech signal to be stored or transmitted and subsequently decoded, thereby reproducing the original speech signal.

Model-based speech encoding permits the speech signal to be compressed, which reduces the number of bits required to represent the speech signal, thereby reducing data transmission rates. The lower data rates are possible because of the redundancy of speech and by mathematically simulating the human speech-generating system. The vocal tract is simulated by a number of "pipes" of differing diameter, and the excitation is represented by a pulse stream at the vocal chord rate for voiced sound or a random noise source for the unvoiced parts of speech. Reflection coefficients at junctions of the pipes are represented by coefficients obtained from linear prediction coding (LPC) analysis of the speech waveform.

In harmonic speech coding systems, the pitch period and harmonic spectral amplitudes play an important role in synthesizing high quality speech. The vocal chord rate is represented by an estimated pitch period. This pitch period dictates the number of harmonic amplitudes. Because pitch varies from one frame of a speech signal to another, the number of harmonic frequencies will vary. For example, there may be a few as 8 harmonics for high pitched speech or as many as 80 for low pitched speech.

One problem encountered in speech encoding is that the varying number of harmonic amplitudes causes difficulty when the amplitudes are quantized. A quantization scheme that is efficient for high pitched speech may be unsuitable for low pitched speakers. On the other hand, a quantization method that is designed to accommodate low pitched speaker may not be efficient. Conventional vector quantization methods suffer from a decrease in efficiency when vector dimensions are increased to improve the quality of speech reproduction.

SUMMARY OF THE INVENTION

One aspect of the invention is a method of using a codebook comprised of codebook vectors to quantize harmonic amplitude vectors. This quantization method is used in a harmonic speech encoder. The inputs to the quantization process are an input vector of harmonic amplitudes and a fundamental frequency associated with the input vector. The input vector is transformed to a zero-mean vector by calculating and subtracting its mean value. This zero-mean vector is then compared to each codebook vector. Specifically, a first codebook vector is selected and sampled at the harmonics of the fundamental frequency associated with the input vector. It now has the same dimension as the input vector, but does not necessarily have a zero mean. Thus, the next step is calculating and subtracting its mean. The zero-mean input vector and the zero-mean codebook vector are compared, thereby obtaining a difference value. This difference value is then weighted, using a weighting value that is obtained from a weighting function of formant peaks sampled at the harmonics of the fundamental frequency. The result is an error value associated with that pair of vectors. This process is repeated, so that input vector is evaluated against each codebook vector. The codebook vector with the minimum error is selected as the codebook vector that best quantizes the input vector.

An advantage of the quantization method is that it provides an efficient quantization of harmonic spectral amplitudes used for harmonic type encoding methods. At that same time, the quantization method accurately represents the speech signal. It thereby enhances speech quality even for low bit rate speech encoders. Specifically, a speech encoder operating at the range of 4 kilobits per second can provide high quality speech.

DETAILED DESCRIPTION OF THE INVENTION

Figure 1A:
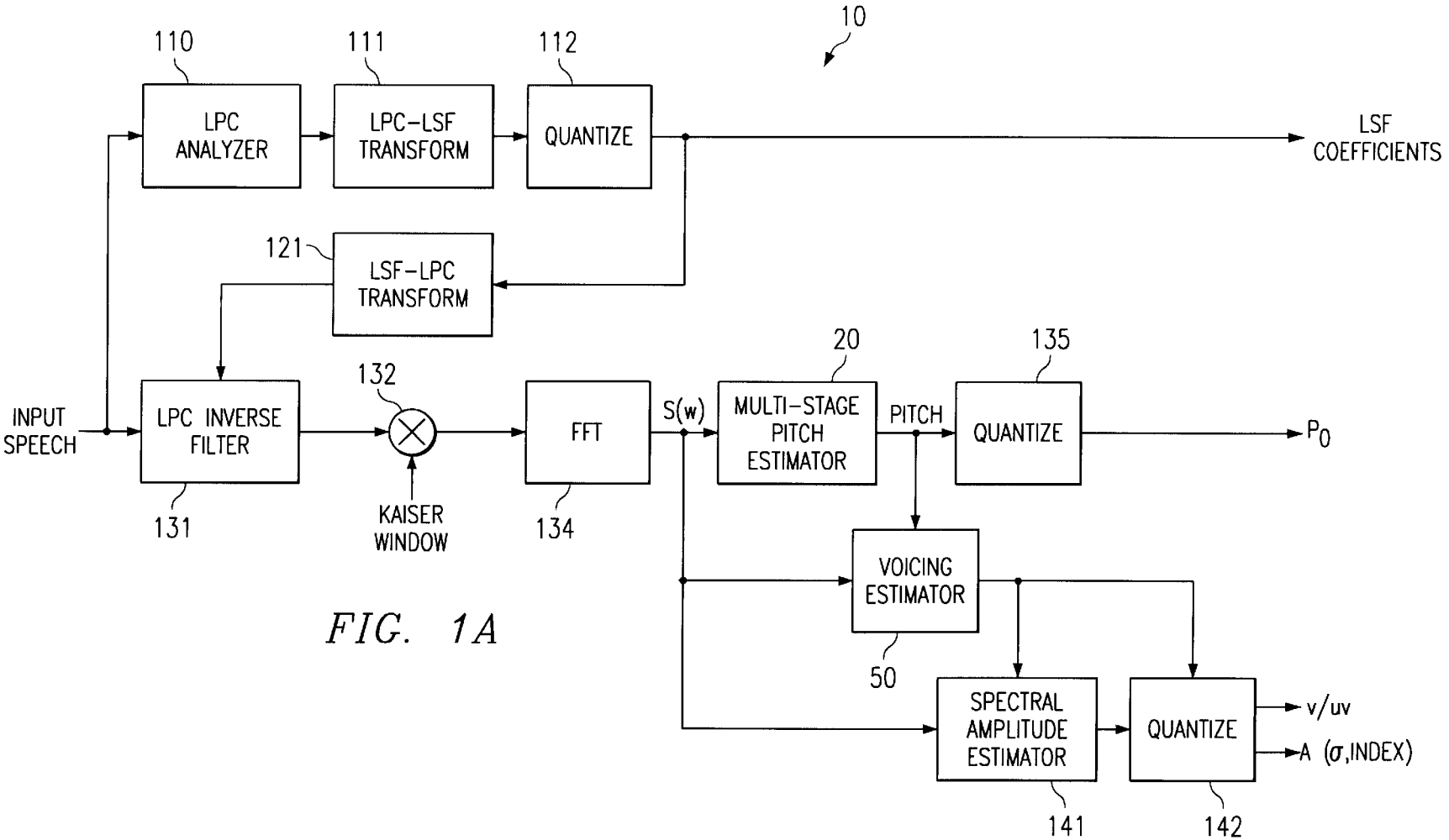
FIGS. 1A and 1B are block diagrams of an encoder and decoder, respectively, designed for use with harmonic amplitude quantization in accordance with the invention.
Figure 1B:
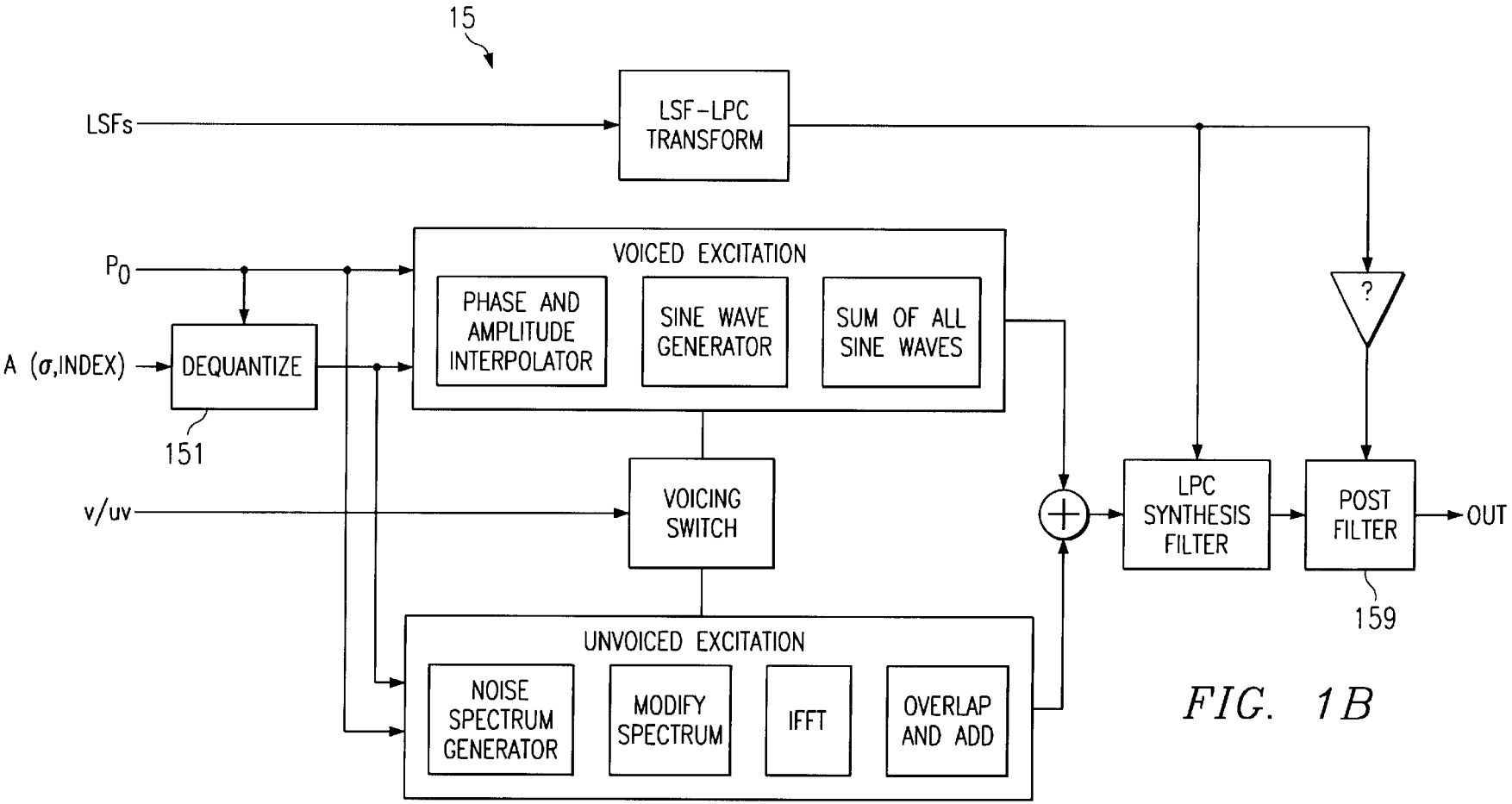

FIGS. 1A and 1B are block diagrams of a speech encoder 10 and decoder 15, respectively. Together, encoder 10 and decoder 20 comprise a model-based speech coding system. As stated in the Background, the model is based on the idea that speech can be represented by exciting a time-varying digital filter at the pitch rate for voiced speech and randomly for unvoiced speech. The excitation signal is specified by the pitch, the spectral amplitudes of the excitation spectrum, and voicing information as a function of frequency.

The invention described herein is primarily directed to the quantizer 142 of FIG. 1A. However, an overview of the complete operation of the coding system is set out below for a more complete understanding of the system aspects of the invention.

In the specific embodiment of FIGS. 1A and 1B, encoder 10 and decoder 15 comprise what is known as a Mixed Sinusoidal Excited Linear Predictive Speech Coder (MSE-LPC), which is a low bit rate (4 kb/s or less) system. However, it should be understood that encoder 10 and decoder 15 comprise but one type of coding system with which a quantizer in accordance with the invention may be used. In general, the quantizer may be used in any harmonic coding system, that is, a coding system in which voiced components are represented with harmonic frequencies of an estimated pitch.

Encoder 10 and decoder 15 are essentially comprised of processes that may be executed on digital processing and data storage devices. A typical device for performing the tasks of encoder 10 or decoder 15 is a digital signal processor, such as the TMS320C30, manufactured by Texas Instruments Incorporated. Except for quantizer 142 and dequantizer 151, the various components of encoder 10 can be implemented with known devices and techniques.

Overview of Speech Coding System

In general, encoder 10 processes an input speech signal by computing a set of parameters that represent a model of the speech source signal and that can be stored or transmitted for subsequent decoding. Thus, given a segment of a speech signal, the encoder 10 must determine the filter coefficients, the proper excitation function (whether voiced or unvoiced), the pitch period, and harmonic amplitudes. The filter coefficients are determined by means of linear prediction coding (LPC) analysis. At the decoder 15, an adaptive filter is excited with a periodic impulse train having a period equal to the desired pitch period. Unvoiced signals are generated by exciting the filter model with the output of a random noise generator. The encoder 10 and decoder 15 operate on speech segments of a fixed length, known as frames.

Referring to the specific components of FIG. 1A, sampled output from a speech source (the input speech signal) is delivered to an LPC (linear predictive coding) analyzer 110. LPC analyzer 110 analyzes each frame and determines appropriate LPC coefficients. These coefficients may be calculated using known LPC techniques. A LPC-LSF transformer 111 converts the LPC coefficients to line spectral frequency (LSF) coefficients. The LSF coefficients are delivered to quantizer 112, which converts the input values into output values having some desired fidelity criterion. The output of quantizer 112 is a set of quantized LSF coefficients, which are one type of output parameter provided by encoder 10.

For pitch, voicing, and harmonic amplitude estimation, the quantized LSF coefficients are delivered to LSF-LPC transform unit 121, which converts the LSF coefficients to LPC coefficients. These coefficients are filtered by an LPC inverse filter 131, and processed through a Kaiser window 132 and FFT (fast Fourier transform) unit 134, thereby providing an LPC excitation signal, S(w). As explained below, this S(w) signal is used by the multi-stage pitch estimator 20, the voicing estimator 50, and the harmonic amplitude estimator 141, to provide additional output parameters.

Pitch estimator 20 provides a pitch value for each current frame. Any one of a number of pitch estimation methods may be used. The output of pitch estimator 20 is delivered to quantizer 135, whose output represents the pitch parameter, $P_0$. As explained below, the estimated pitch value is also delivered to the voicing estimator 50.

Voicing estimator 50 provides data representing the voiced or unvoiced characteristics of the current frame. This output is quantized by quantizer 142 thereby providing the output parameters, u/uv. The voicing output is also used by the spectral amplitude estimator 141, whose output is quantized by quantizer 142 to provide the voicing parameters, u/uv, and the harmonic amplitude parameters, A.

It should be understood that the harmonic amplitude parameters, identified as A in FIG. 1A, can take various forms. As explained below in connection with FIGS. 3 and 5, a feature of the invention is that these parameters can be transmitted as a codebook index and a mean value. Also, the spectral amplitudes for each frame are identified below as a vector, $A_k$, or in terms of magnitudes, $M_k$.

As described below, quantizer 142 uses a formant weighting approach to quantizing harmonic amplitudes. The design of quantizer 142 involves a code-book training process, which is described below in connection with FIG. 2. FIGS. 3 and 4 are block diagrams of the encoding and decoding, respectively, of the harmonic amplitudes.

The following description is in terms of calculations in the logarithmic domain. However, the same concepts could be applied to calculations in the linear domain with appropriate modifications to the equations set out below.

CodeBook Training

Figure 2:
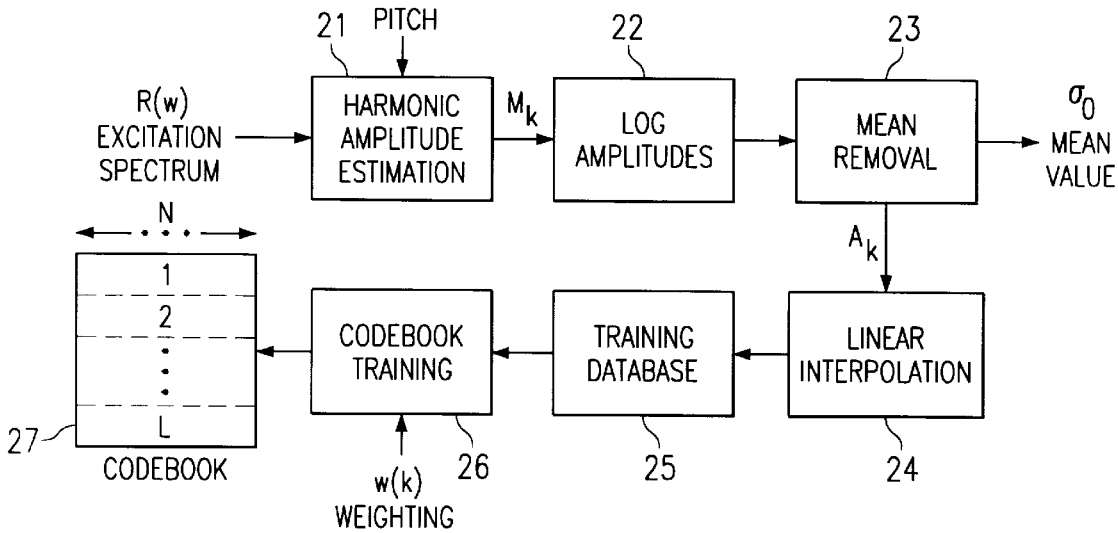
FIG. 2 illustrates a process of training a quantization codebook in accordance with the invention
Figure 3:
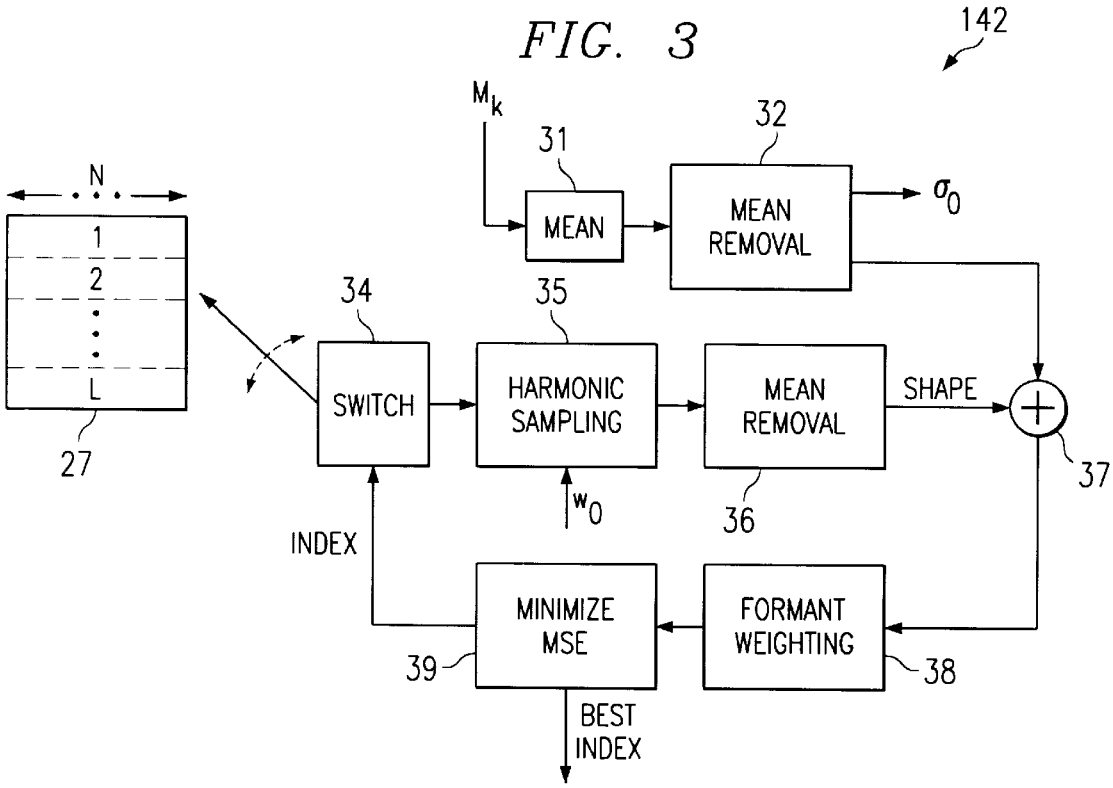
FIG. 3 illustrates the process performed by the quantizer of the encoder of FIG. 1A.

FIG. 2 illustrates the process of codebook training. The object of this training process, steps 21–26, is to produce a codebook 27, which can be used during encoding to quantize harmonic amplitudes. The codebook 27 has L number of entries, and each entry is a vector having dimension N. As is conventional, the number of entries is a function of the number of bits being quantized. For example, for 10-bit quantization, $L=2^{10}$. As explained below, the vector dimension N is selected to balance performance and memory requirements.

As stated in the Background, the number of harmonics in a speech signal is a function of fundamental frequency (represented as pitch) of a speech signal. Thus, the number of harmonics varies as pitch varies. Where an encoder estimates a new pitch every frame, the number of harmonics also varies from frame to frame. The number of harmonic amplitudes for a given pitch is identified herein as H.

Steps 21–24 are directed to obtaining a set of codebook training vectors. In step 21, harmonic amplitudes of an excitation signal, R(w), are estimated, by using a pitch value to sample R(w) at harmonic frequencies of that pitch. The excitation signal, R(w), is an LPC excitation signal, such as might be obtained from the FFT 134 of encoder 10. For each new pitch value, the result of step 21 is a harmonic amplitude vector, $M_k$, where k=1 to H. The harmonic amplitudes are "vectors" in the sense that for each frame, there are a number of amplitude values. Each $M_k$ vector has a variable dimension, H.

In step 22, the harmonic amplitudes are transformed to the logarithmic domain. In step 23, the mean value of each vector is removed. The result is a zero-mean vector having spectral shape $A_k$. Steps 22 and 23 may be expressed mathematically as:

$$A_k=\log_{10}(M_k)-\sigma_0$$

, where $1 \leqq k \leqq H$. The value $\sigma_0$ is the mean value of the vector in log domain, which may be expressed as:

$$\sigma_0 = \frac{1}{H}\sum_{k=1}^{H}[\log_{10}(M_k)]$$

Step 24 is an interpolation step. Because the number of harmonics, H, varies from frame to frame, it difficult to directly quantize the harmonic amplitude vectors. Therefore, their spectral shapes are interpolated to produce a fixed vector dimension. This fixed vector dimension is selected with regard to both performance and memory requirements of the coding system.

A small vector dimension uses less memory, but results in less successful performance than a larger vector dimension. In the example of this description, the speech frequency bandwidth is 300–3400 Hz. For this bandwidth, there is a maximum of 60 harmonics for low pitched speakers. In light of performance and memory considerations, a suitable vector dimension might be 64.

The interpolation of step 24, which produces a fixed vector dimension for each frame, may be accomplished with any one of several interpolation techniques. An example of a suitable interpolation technique is linear interpolation, where interpolated spectral shapes of the harmonic amplitudes, E(w), are calculated as:

$$E(\omega) = A_k + \left(\frac{\omega - k\omega_0}{(k+1)\omega_0 - k\omega_0}\right)(A_{k+1} - A_k),$$

where $kw_0 \leqq w \leqq (k+1)w_0$ and $w_0$ is the fundamental frequency. The fundamental frequency can be computed as:

$$w_0 = 2N/P_0$$

, where $P_0$ is the pitch period in samples at an 8 kHz sampling rate and N is the vector dimension that is to be used for the training. As stated above, a suitable vector dimension is 64, such that N=64 in the example of this description.

The result of step 24 is a set of vectors, E(w), one for each frame, where w=0 to N−1. In step 25, these vectors are stored in a training database for use as codebook training vectors. Each vector represents a harmonic amplitude having a fixed dimension, N, which is suitable for vector quantization.

In step 26, the codebook is "trained" by generating a codebook vector for each of the L number of codebook cells. Apart from the derivation of the fixed dimension training vectors, which are derived in accordance with steps 21–24, the training process applies conventional codebook training techniques. Codebook vectors are generated iteratively from a set of candidate codebook vectors, $Y_j$, j=1 to L, which are initialized and modified at each iteration to minimize error. Expressed mathematically, the codebook training process involves minimizing the long-term average for each codebook vector, using a mean squared error criterion, as follows:

$$\epsilon = \frac{1}{M}\sum_{i=0}^{M-1} d_i(X, Y),$$

where M is the number of vectors in the training database. The X vectors are the training vectors, E(w), that were stored in step 25.

As indicated in the above equation, the training vectors and the codebook vectors are compared by calculating distortion values, d. Each distortion value, d, is calculated as follows:

$$d_i(X, Y) = \min\left[\sum_{n=0}^{N-1} [x_i(n) - y_j(n)]^2\right],$$

where d is evaluated for i=1 to M, and where n=1 to N is an index of the vector dimension. To obtain the distortion value, each codebook vector is subtracted from a training vector to find the codebook vector with the least error. The process of calculating distortion values and finding the "best" codebook vector is repeated for each training vectors. Then, the average error value, $\epsilon$, is obtained for that iteration of codebook vectors. The iterations are repeated with new codebook vectors until the average error indicates that the optimum codebook vectors have been generated. Various algorithms have been developed for determining how the codebook vectors are to be initialized and modified for each next iteration.

An alternative training process uses a weighting function during the distortion calculations. The elements of the input vector, X, are given unequal weights. Expressed mathematically:

$$d_i = \min\left[\sum_{n=0}^{N-1} [x_i(n) - y_i(n)]^2 (\omega(n))^2\right],$$

where w(n) is the weighting function. In spectral magnitude quantization, low frequency harmonics are perceptually more important that high frequency harmonics. Thus, the weighting function favors low frequency harmonics as follows:

$$\omega(n) = \left[1.0 - \left(\frac{\beta n}{N}\right)\right]^{\alpha},$$

where n=0 to N. The values $\alpha$ and $\beta$ are fractional constants. Suitable values of $\alpha$ and $\beta$ have been found to be 0.8 and 0.25, respectively.

Quantization of Harmonic Magnitudes

FIG. 3 illustrates the process performed by quantizer 142 of the encoder 10 of FIG. 1A. As explained below, quantizer 142 uses a trained codebook 27 to quantize harmonic amplitudes in accordance with the invention. FIG. 4 illustrates the reverse process, which is performed at the decoder 15 by a dequantizer 151.

Referring to FIG. 3 and the quantization process, the input values, $M_k$, are harmonic magnitudes, such as might be obtained from the spectral amplitude estimator 141 of FIG. 1A. As explained above in connection with FIG. 2, in general, harmonic amplitudes are variable length vectors, having a dimension, H, that varies as pitch varies. Where a new pitch is estimated every frame, the vector dimension varies from frame to frame. It is assumed that quantizer 142 is part of an encoder that provides a pitch value (or, equivalently, a value from which pitch can be calculated) for each harmonic amplitude vector.

Steps 31 and 32 are directed to transforming each next harmonic amplitude vector to a zero-mean vector. Thus, step 31 is obtaining the log form of the input vector, $M_k$, which has the vector size, H. Step 32 is calculating and removing the mean value, which may be accomplished in the manner described above in connection with codebook training. The result is the vector to be quantized, $A_k$. As explained below in connection with FIG. 4, the mean value is transmitted as a parameter and may be first quantized.

Steps 34–36 are directed to obtaining each next vector of the L codebook vectors. As explained above in connection with codebook training, The codebook vectors have a fixed dimension, N. In step 34, a current codebook vector is selected. In step 35, the vector is sampled at a fundamental frequency, $w_0$, which is a function of the current pitch value and the codebook vector dimension, as described above in connection with training.

The sampling of step 35 produces a modified codebook vector, $C_i(kw_0)$, sampled at the harmonics of the fundamental frequency, $w_0$. This sampled codebook vector has the same dimension as the input vector, $A_k$. However, the codebook vector does not necessarily have a zero mean, as does $A_k$. In step 36, the mean of the codebook vector is calculated as follows:

$$\sigma_i = \sum_{k=1}^{H} C_i(k\omega_0),$$

where i=0 to L, and L is the number of codebook vectors. The mean value is then subtracted, so that the codebook vector is a zero-mean vector.

In step 37, the zero-mean input amplitude vector, $A_k$, is compared with the zero-mean codebook vector sampled at $k\omega_0$, $C_i(k\omega_0)-\sigma_i$, resulting in a difference value. In step 38, a formant weighting function is applied to the difference value. This results in an error value, $\epsilon(i)$, corresponding to that codebook vector. The calculation of steps 37 and 38 may be expressed as:

$$\epsilon(i) = \sum_{k=1}^{H} [A_k - C_i(k\omega_0) - \sigma_i]^2 (\omega_m(k\omega_0))^2,$$

where i=0 to L. The weighting function, $w_m(k\omega_0)$, is adaptively defined for each speech frame (unlike the weighting function used during training). Because each frame has a different pitch, its weighting function is different. For each frame, the weighting is calculated as follows:

$$w_m(k\omega_0) = w(k\omega_0)\left[\frac{H(k\omega_0)}{F(k\omega_0)}\right]^{\gamma},$$

where $w(k\omega_0)$ is defined as:

$$\omega(k\omega_0) = \left[1.0 - \left(\frac{\beta(k\omega_0)}{N}\right)\right]^{\alpha},$$

for $kw_0$=0 to N. The $H(k\omega_0)$ values represent the frequency response of an LPC filter sampled at the harmonics of the fundamental frequency. The $F(k\omega_0)$ values represent the linear interpolated formant peaks sampled at the harmonic frequencies. The exponent, $\gamma$, is a constant fractional value, which controls the distance between formant peaks and formant nulls. The value of $\gamma$ may be determined experimentally, with a suitable value being 0.3.

The weighting function described in the preceding paragraph is a "formant weighting" function. It is based on the idea that information at formant amplitudes is more significant than the information at null amplitudes Referring to FIG. 1B, a post-filter 159 of decoder 15 tends to attenuate null amplitudes, thus accurate quantization is unnecessary. However, formant amplitudes are not altered by the post-filter 159. Thus, they are quantized more accurately.

Figure 4A:
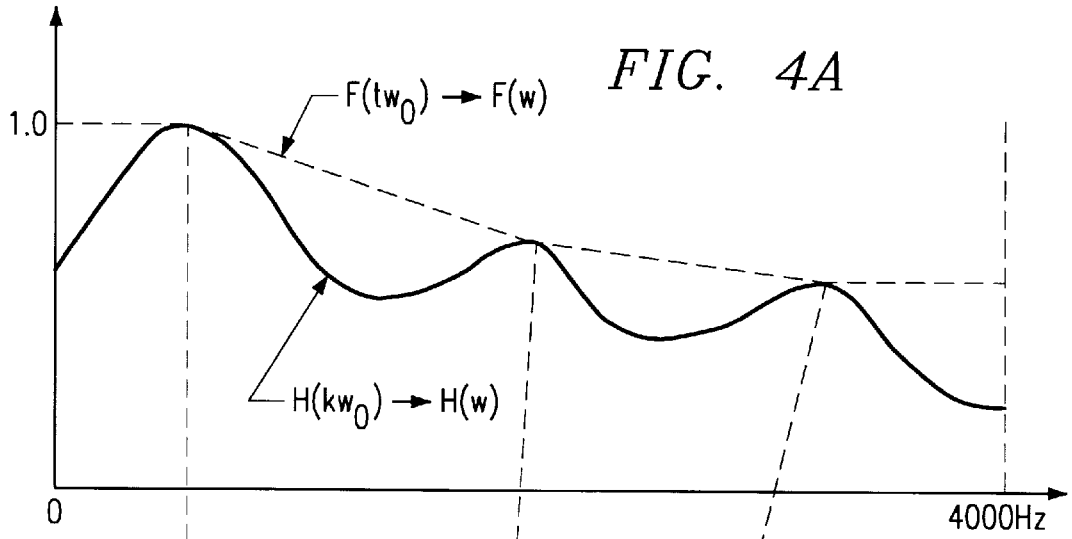
FIGS. 4A–4C are graphs illustrating the formant weighting function used in the weighting step of FIG. 3.
Figure 4B:
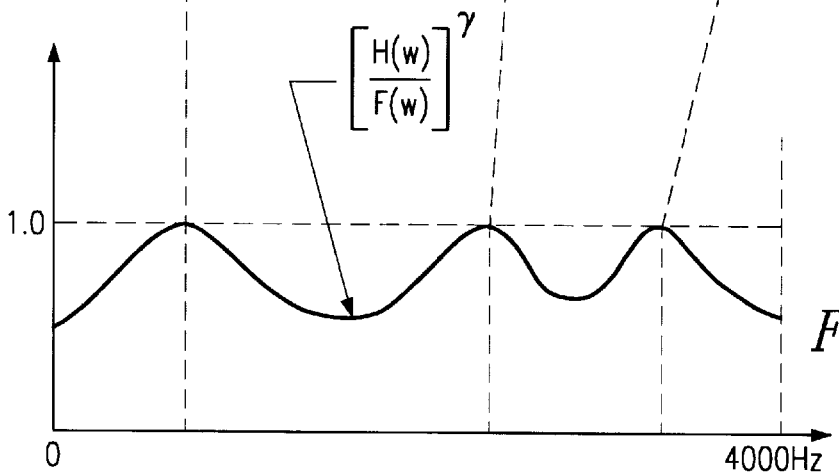
Figure 4C:
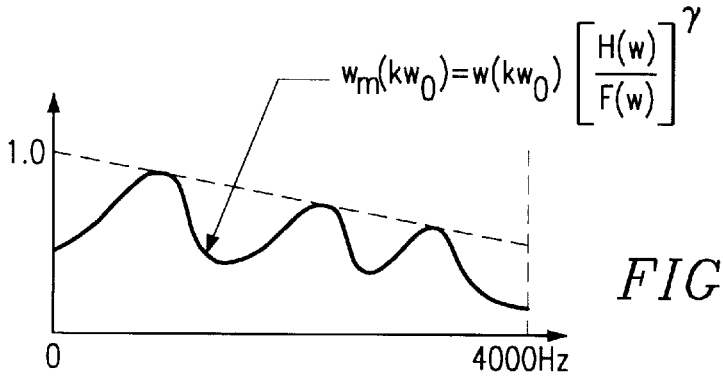
Figure 5:
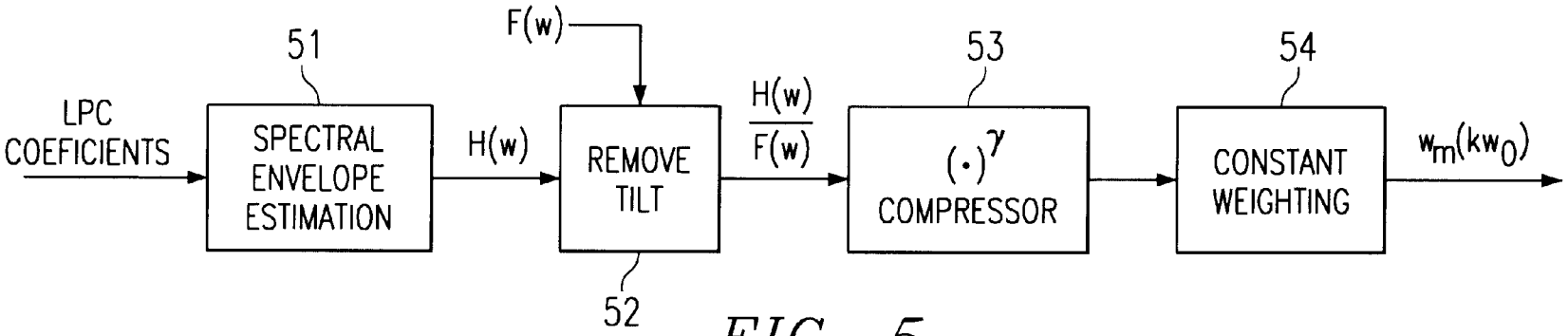
FIG. 5 illustrates the steps of deriving the formant weighting function used in the weighting step of FIG. 3.

FIGS. 4A–4C and FIG. 5 illustrate how to obtain the weighting function for the above described formant weighting. FIG. 5 is a block diagram of the process steps illustrated graphically in FIGS. 4A–4C. In step 51, the LPC coefficients are used to estimate the spectral envelope, resulting in H(w). In other words, H(w) is the frequency response of an LPC filter. FIG. 4A illustrates H(w) and F(w) as continuous values from which sampled values, $H(kw_0)$ and $F(kw_0)$, are obtained. In step 52, the spectral tilt is removed by division of the two signals. In step 53, the results of step 52 are compressed with the $\gamma$ exponent. FIG. 4B illustrates the waveform of the flattened and compressed values. In step 54, the constant weighting value, $w(kw_0)$, is applied, resulting in the formant-weighted value for the current frame.

Referring again to FIG. 3, in step 39, the weighted error value is compared with the error value of the previous codebook vector. The codebook vector having the smaller error is selected as the current "best", codebook vector. The next codebook vector is selected and the process of steps 34–39 is repeated. In this manner, all codebook vectors are processed to find the codebook vector that best represents the quantized harmonic amplitude of $A_k$.

Figure 6:
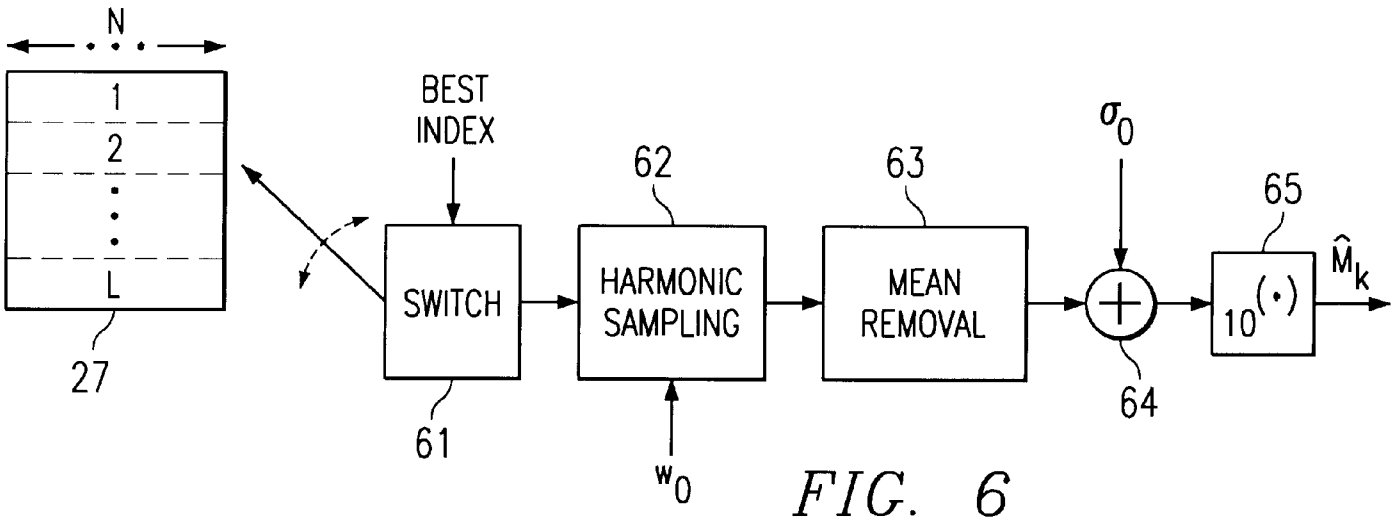
FIG. 6 illustrates the process performed by the dequantizer of the decoder of FIG. 1B.

FIG. 6 illustrates the process performed at a decoder, such as decoder 15, which decodes parameters provided by an encoder. These parameters include indices for the quantized codebook vectors that best represent the harmonic amplitude vectors, as well as fundamental frequency parameter, $w_0$ and a mean value, $\sigma_0$ for each harmonic amplitude vector. In step 61, the codebook is accessed to obtain the codebook vector associated with the transmitted index. In step 62, this codebook vector is sampled at the fundamental frequency associated with the pitch parameter for the current frame. Now, the codebook vector has the desired dimension but is not necessarily a zero-mean vector. In step 63, the mean of the codebook vector is calculated and removed. In step 64, the mean associated with the harmonic amplitude vector being dequantized, $\sigma'_0$, is added. As stated above in connection with the quantization process of FIG. 3, the mean value may be a quantized version of the mean calculated in step 32 of quantization.

In step 65 of the dequantization process, the inverse log is obtained. The result is the synthesized harmonic amplitude vector, $M'_k$.

Other Embodiments

Although the present invention has been described with several embodiments, various changes and modifications may be suggested to one skilled in the art. It is intended that the present invention encompass such changes and modifications as fall within the scope of the appended claims.

What is claimed is:

1. A method of training a codebook for use in quantizing or dequantizing harmonic amplitudes of a speech signal, comprising the steps of:

selecting a first vector of said harmonic amplitudes, said first vector having a dimension corresponding to the number of harmonics associated with an first input pitch value;

transforming said first vector to a zero-mean vector;

interpolating the results of said transforming step, thereby obtaining an interpolated vector having a predetermined dimension;

repeating the above steps for a number of vectors of said harmonic amplitudes, thereby obtaining a set of interpolated vectors all having said predetermined dimension; and training said codebook, using said interpolated vectors as input vectors for a codebook training process.

2. The method of claim 1, wherein said first vector is obtained by harmonic amplitude estimation of an excitation signal.

3. The method of claim 1, wherein said input vectors are transformed to a logarithmic domain.

4. The method of claim 1, wherein said interpolating step is performed with linear interpolation.

5. The method of claim 1, wherein said interpolating step is performed by calculating a vector difference value of said input vector and at least one other input vector, multiplying said difference value times a weighting factor that is a function of a fundamental frequency derived from said pitch value and said predetermined dimension, and adding the result to said input vector.

6. The method of claim 1, wherein said training step is performed by calculating vector difference values and multiplying each of said difference values times a weighting value, wherein said weighting value favors low frequency harmonics.

7. A method of using a codebook comprised of codebook vectors having a fixed dimension, to quantize a harmonic amplitude vector, in a system that encodes a speech signal, comprising the steps of:

receiving a first input vector of harmonic amplitudes and a fundamental frequency associated with said first input vector;

transforming said first input vector to a zero-mean input vector;

selecting a first codebook vector;

sampling said first codebook vector at harmonics of said fundamental frequency;

transforming said first codebook vector to a zero-mean codebook vector;

subtracting said zero-mean input vector from said zero-mean codebook vector, thereby obtaining a difference value;

weighting said difference value, using a weighting value that is obtained from a weighting function of formant peaks sampled at harmonics of said fundamental frequency, thereby obtaining an error value;

repeating the above steps for a number of codebook vectors; and selecting the codebook error having said error value that is smallest.

8. The method of claim 1, wherein said fundamental frequency is derived from a pitch associated with said input vector and from said predetermined dimension.

9. The method of claim 1, wherein said codebook vectors are in logarithmic domain and further comprising the step of transforming said input vector to said logarithmic domain.

10. The method of claim 1, wherein said weighting function is a ratio of an LPC frequency response to an interpolated signal of said formant peaks, both sampled at harmonics of said fundamental frequency.

11. The method of claim 10, wherein said ratio is exponentiated to a fractional exponent representing the distance between formant peaks and formant nulls.

12. The method of claim 10, wherein said ratio is multiplied by a weighting factor that favors low harmonic frequencies.

13. A method of using a codebook comprised of codebook vectors having a fixed dimension, to dequantize a harmonic amplitude vector, in a system that decodes a speech signal, comprising the steps of:

selecting a first codebook vector;

sampling said first codebook vector at a harmonics of a fundamental frequency associated with a harmonic amplitude vector to be quantized, thereby providing a codebook vector having the same dimension as said harmonic amplitude vector;

transforming said codebook vector to a zero-mean vector; and adding a mean associated with said harmonic amplitude vector to the results of said transforming step.

14. The method of claim 13, wherein said codebook vectors are in the logarithmic domain and further comprising the step of obtaining the inverse log of said codebook vector.

* * * * *